US008142159B2

(12) United States Patent
Chang et al.

(10) Patent No.: US 8,142,159 B2
(45) Date of Patent: Mar. 27, 2012

(54) FAN AND MOTOR THEREOF

(75) Inventors: Chia-Hsuan Chang, Taoyuan Hsien (TW); Meng-Yu Chen, Taoyuan Hsien (TW); Yung-Hao Chiu, Taoyuan Hsien (TW); Te-Tsai Chuang, Taoyuan Hsien (TW); Chung-Yuan Tsang, Taoyuan Hsien (TW); Wei-Pang Huang, Taoyuan Hsien (TW)

(73) Assignee: Delta Electronics, Inc., Kuei San, Taoyuan Hsien (TW)

( * ) Notice: Subject to any disclaimer, the term of this patent is extended or adjusted under 35 U.S.C. 154(b) by 857 days.

(21) Appl. No.: 12/191,708

(22) Filed: Aug. 14, 2008

(65) Prior Publication Data

US 2009/0045588 A1 Feb. 19, 2009

(30) Foreign Application Priority Data

Aug. 15, 2007 (TW) ..... 96213490 U
Apr. 1, 2008 (TW) ..... 97205538 U

(51) Int. Cl.

| | |
|---|---|
| ***B64C 27/00*** | (2006.01) |
| ***F01D 11/00*** | (2006.01) |
| ***F01D 25/16*** | (2006.01) |
| ***F01D 25/18*** | (2006.01) |
| ***F03D 11/00*** | (2006.01) |
| ***F04D 29/04*** | (2006.01) |
| ***F04D 29/08*** | (2006.01) |

(52) U.S. Cl. ..... 416/174; 417/423.12; 417/423.13; 310/90

(58) Field of Classification Search ..... 416/174; 417/423.12, 423.13; 310/90; 384/94, 100, 384/130, 132, 537

See application file for complete search history.

(56) References Cited

U.S. PATENT DOCUMENTS

| | | | | |
|---|---|---|---|---|
| 6,954,017 | B2 * | 10/2005 | Takahashi et al. | 310/85 |
| 7,521,830 | B2 * | 4/2009 | Chen et al. | 310/90 |
| 7,712,963 | B2 * | 5/2010 | Lin et al. | 384/100 |
| 2007/0076990 | A1 * | 4/2007 | Tsai et al. | 384/100 |
| 2007/0253652 | A1 * | 11/2007 | Shishido et al. | 384/107 |

* cited by examiner

*Primary Examiner* — Anh Phung
*Assistant Examiner* — Toan Le
(74) *Attorney, Agent, or Firm* — Muncy, Geissler, Olds & Lowe, PLLC

(57) ABSTRACT

A fan includes a plurality of blades and a motor. The motor includes a hub and a shaft having an end connected to the hub, a bushing, a bearing, and an oil-sealing structure. The blades are connected with and surrounding around the hub. The bushing is for supporting the other end of the shaft, and the bearing is disposed in the bushing and used to telescope the shaft. The shaft passes through the oil-sealing structure. The oil-sealing structure is telescoped to the shaft to fit tightly and the oil-sealing structure includes a main body and a barricade inwardly extending toward the shaft so that the oil-sealing structure is fixedly connected with the bushing.

19 Claims, 11 Drawing Sheets

5

FAN AND MOTOR THEREOF

CROSS REFERENCE TO RELATED APPLICATIONS

This Non-provisional application claims priority under 35 U.S.C. §119(a) on Patent Application No(s). 096213490, filed in Taiwan, Republic of China on Aug. 15, 2007, and Patent Application No(s). 097205538, filed in Taiwan, Republic of China on Apr. 1, 2008, the entire contents of which are hereby incorporated by reference.

BACKGROUND OF THE INVENTION

1. Field of the Invention

The present invention relates to a fan and a motor thereof, and more particularly to the fan and motor capable of preventing lubricating oil from being evaporated to outside of the fan and enhancing the combination of a magnetic-conducting device, a shaft, and an oil-sealing structure.

2. Description of the Related Art

Fans are driven by motors to rotate, and properties of the motors determine the quality of the fans. A bearing is also an important element for supporting a shaft in the motor. If the bearing does not provide sufficient lubrication and fixation to the shaft, noise is easy to generate.

Metallic shafts supported by oil-contained bearings are a common skill to extend the operating life of a motor of a fan. For example, FIG. 1 is a schematic sectional view of a conventional fan 1. The fan 1 includes an oil sealing 11, an oil-contained bearing 12, a shaft tube 13, and a metallic shaft 14 supported by the oil-contained bearing 12. The oil sealing 11 is disposed between the shaft tube 13 and the metallic shaft 14.

The oil-contained bearing 12 is metallically casted by metallic particles and lubricating oil is pressurized into voids of the aggregated metallic particles. When the fan 1 is rotated, the lubricating oil held in the voids of the aggregated metallic particles is leaked, thereby lubricating the contact surfaces therebetween. Because of evaporation of the lubricating oil by heat and frictional loss, the function of the oil-contained bearing 12 is gradually diminished after long-term operation. Thus, noise increases and the oil-contained bearing 12 and the metallic shaft 14 begins to stick and malfunction. Although the oil sealing 11 disposed between the shaft tube 13 and the metallic shaft 14 is applied in controlling the loss of the lubricating oil, the lubricating oil still flows out of the shaft tube 13 via the clearance formed between the oil sealing 11 and the metallic shaft 14. Moreover, situated in an environment with long-term vibration, the oil sealing 11 will often loosen and fail, resulting in loss of the lubricating oil.

BRIEF SUMMARY OF THE INVENTION

To solve the aforementioned problems, the present invention provide a fan and a motor thereof for improving an oil-contained bearings incapable of holding lubrication oil, eliminating noise and sticking caused by insufficient oil lubrication of the shaft, increasing life span and stability of the product.

In addition, the present invention further provide a fan and a motor thereof for utilizing a bushing having a heat-melt portion, and a h-shape oil-sealing structure telescoped to a top wall of the bushing to enhance the combination of a shaft, a magnetic-conducting device and an oil-sealing structure and prevent the shaft, the magnetic-conducting device and the oil-containing bearing from loosing or dropping for extending the operating lifetime of the fan and the motor thereof. Besides, if a low cost plastic bushing is chosen and replaces the metal bushing, it can save the cost of material and enhance the product competition ability.

To achieve the aforementioned goals, the present invention provides a motor including a hub and a shaft comprising an end connected to the hub, a bushing, a bearing and an oil-sealing structure. The bushing is for supporting the other end of the shaft, and the bearing is disposed in the bushing and used to telescope the shaft. The oil-sealing structure is telescoped to the shaft to fit tightly and the oil-sealing structure includes a main body and a barricade inwardly extending toward the shaft so that the oil-sealing structure is fixedly connected with the bushing.

In the above-mentioned motor, the oil-sealing structure and the bushing are fitted tightly, thereby pressing the oil-sealing structure against the bushing, and the barricade comprises a top surface, and a declined angle is formed between the top surface of the barricade and a radial direction of the motor. The thickness of the barricade is gradually reduced from the main body of the oil-sealing structure toward the shaft, and the barricade and the main body of the oil-sealing structure are integrally formed or molded as a single piece.

In the above-mentioned motor, a lubricating liquid disposed between the bearing and the shaft, wherein an oil-storing space is defined by the main body of the oil-sealing structure, the bushing and the bearing, and the oil-storing space is utilized to store the lubricating liquid overflowing from a breach between the bearing and the shaft. The motor further comprises a gap formed between the barricade of the oil-sealing structure and an outside of the shaft, and the lubricating liquid is partially overflowing to the oil-sealing structure through the gap.

In the above-mentioned motor, the hub further comprises a plurality of extending walls surrounding a periphery of the shaft and a plurality of slots, each slot is formed between each two adjacent extending walls the slot is utilized to receive the lubricating liquid overflowing from the gap, and a slot-bottom plane higher than the main body of the oil-sealing structure. Further, the main body of the oil-sealing structure comprises a top wall, and a separation distance is spaced between the top wall of the main body of the oil-sealing structure and the extending walls of the hub.

In the above-mentioned motor, the barricade of the oil-sealing structure further comprises at least one crook bent toward the bearing, and the barricade of the oil-sealing structure further comprises at least one guiding slot formed and divided by the crook. Also, the barricade of the oil-sealing structure further comprises a bottom surface, the bottom surface of the barricade of the oil-sealing structure is parallel to the radial direction of the motor and pressed against the bushing. Further, the main body of the oil-sealing structure comprises a bottom wall, the motor further comprises a magnetic-conducting device used to telescope the bushing, the bottom wall is presses against the magnetic-conducting device, and an inner side of the bottom wall of the main body of the oil-sealing structure is pressed against an outside of the bushing the motor further has a base, wherein the bushing is extending from the base, and the bushing comprises an opening end, and the oil-sealing structure is disposed on an opening end of the bushing In the above-mentioned motor, the bushing has a top wall and at least one heat-melt portion disposed on a top wall of the bushing, at least one through hole is disposed in the barricade of the oil-sealing structure, and when the oil-sealing structure is telescoped to the bushing, each heat-melt portion of the bushing passes through the corresponding through hole of the oil-sealing structure to expose, and the heat-melt portion is melted by heating and cooled to be formed on the oil-sealing structure so as to combine the oil-sealing structure with the bushing firmly. Also, the main body of the oil-sealing structure further comprises a bottom wall, the motor further comprises a magnetic-conducting device used to telescope the bushing, and when the oil-sealing structure telescopes to the bushing of the main body of the oil-sealing structure, the bottom wall fits tightly to the magnetic-conducting device.

To achieve the aforementioned goals, the present invention further provides a fan including a plurality of blades and the above-mentioned motor. The blades are connected with and surrounding around the hub.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the present invention. This description is made for the purpose of illustrating the general principles of the present invention and should not be taken in a limiting sense. The scope of the present invention is best determined by reference to the appended claims.

Figure 1:
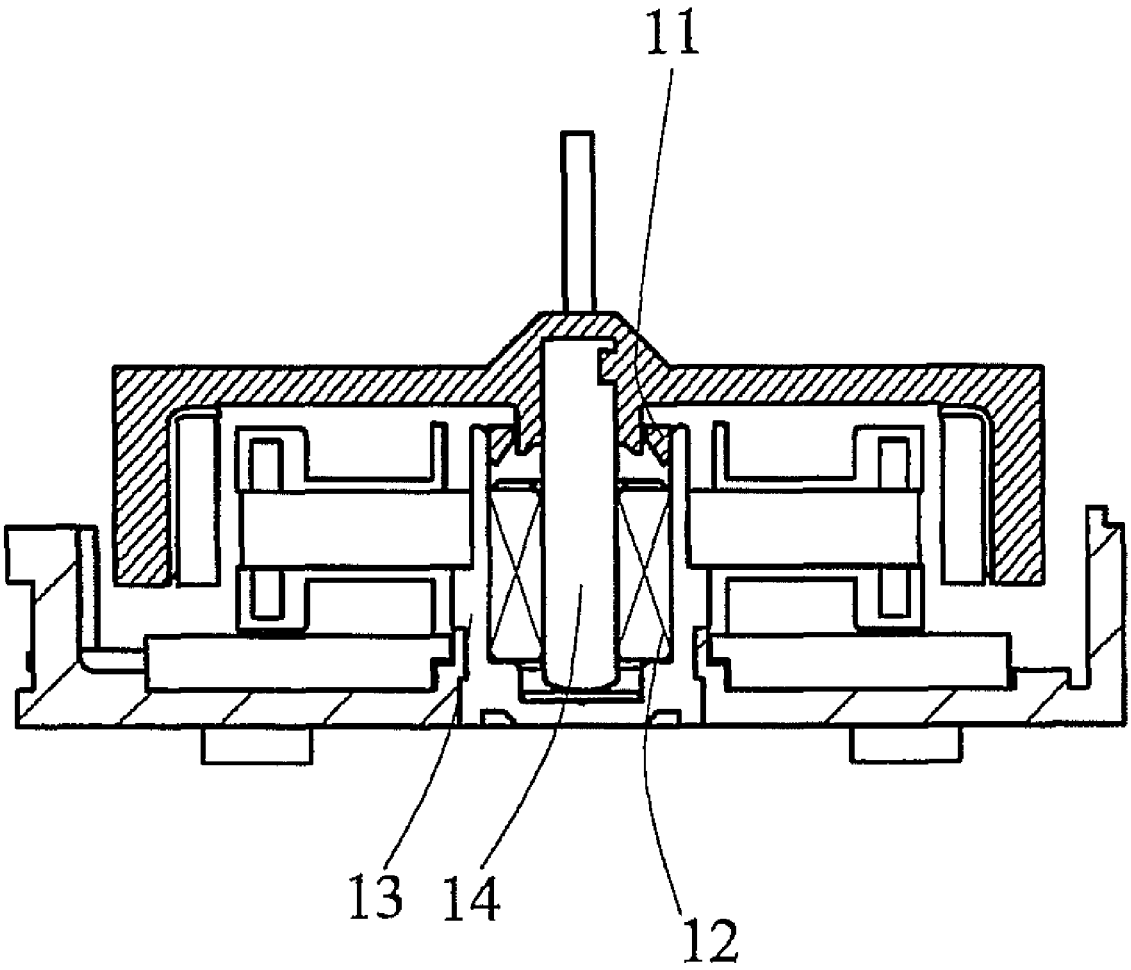
FIG. 1 ( PRIOR ART )
FIG. 1 is a schematic sectional view of a conventional fan.
Figure 2A:
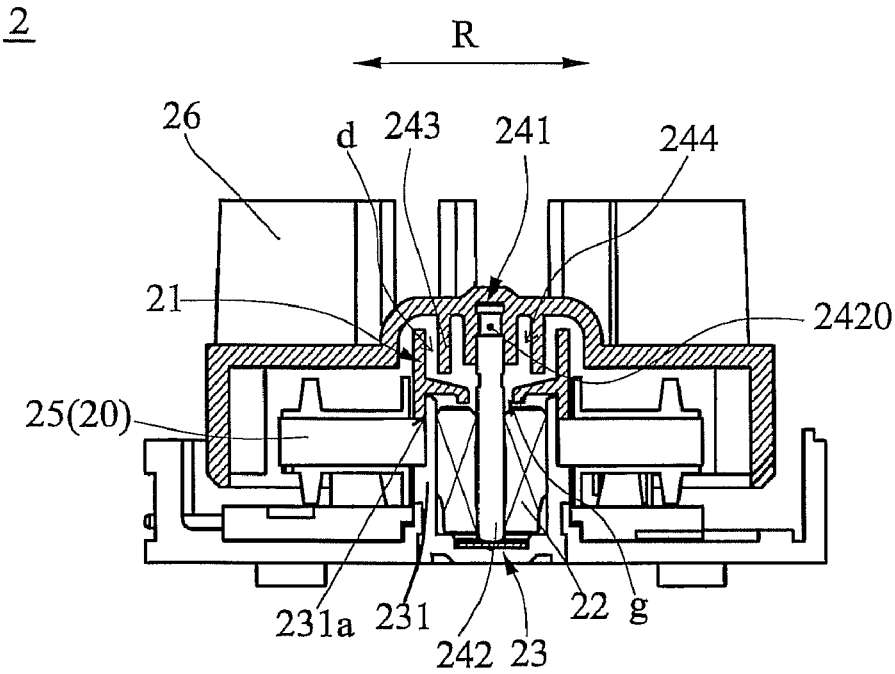
FIG. 2A is a schematic sectional view of a fan according to a first embodiment of the present invention.

FIG. 2A is a schematic sectional view of a fan 2 according to a first embodiment. The fan 2 includes a motor 20 and a plurality of blades 26. The motor 20 includes an oil-sealing structure 21, a bearing 22, a base 23, a bushing 231 extending from the base 23 and having an opening end, a hub 241 and a shaft 242, a magnetic-conducting device 25, a lubricating liquid disposed between the bearing 22 and the shaft 242. The blades 26 are connected with and surrounding around the hub 241. The bearing 22 is disposed in the bushing 231 and used to telescope the shaft 242. The shaft 242 has an end 2420 connected to the hub 241.

The hub 241 includes a plurality of extending walls 243 and a plurality of slots 244, and each slot 244 is formed between each two adjacent extending walls 243. The shaft 242 is disposed in the bearing 22. The extending walls 243 of the hub 241 surround the periphery of the shaft 242, i.e., the slots 244 of the hub 241 surround the periphery of the shaft 242. The shaft 242 passes through the oil-sealing structure 21 disposed on the opening end of the bushing 231. The magnetic-conducting device 25 includes a plurality of silicon steel sheets wound by coils, and the magnetic-conducting device telescopes the bushing 231. Driven by the motor 20, the blades 26 are rotated to generate airflow. In this embodiment, the fan 2 can be an axial fan or a centrifugal fan.

Figure 2B:
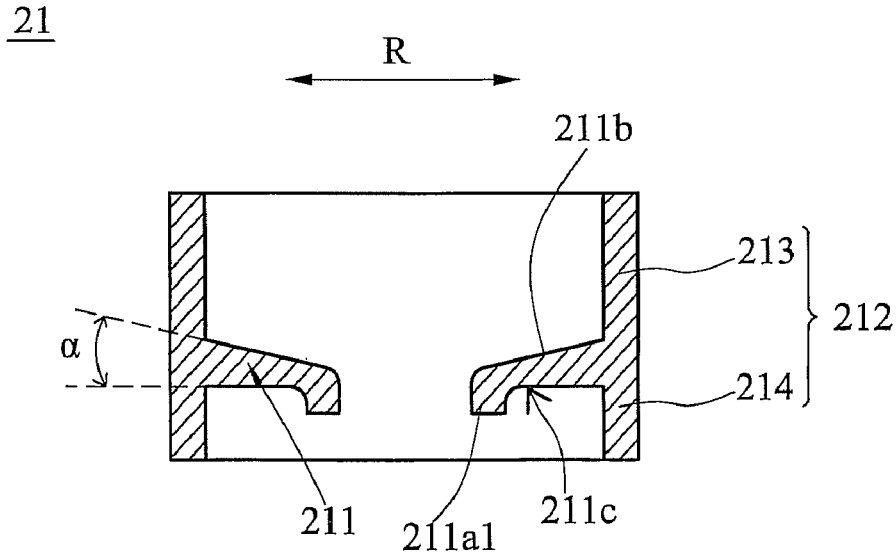
FIG. 2B is a schematic view of an oil-sealing structure in FIG. 2A.

Referring also to FIG. 2B, FIG. 2B is a schematic view of an oil-sealing structure 21 in FIG. 2A. The oil-sealing structure 21 is telescoped to the shaft to fit tightly, and the oil-sealing structure 21 includes a barricade 211 and a main body 212. In this embodiment, the barricade 211 and the main body 212 of the oil-sealing structure 21 are integrally formed or molded as a single piece. The barricade 211, disposed on the inside of the main body 212 and inwardly extending toward the shaft 242, has a top surface 211*b* and a bottom surface 211*c*. The top surface 211*b* is an inclined surface, thus, a declined angle "α" is formed between the top surface 211*b* of the barricade 211 and a radial direction "R" of the motor 20, thereby guiding the lubricating liquid located on the top surface 211*b*. The bottom surface 211*c* of the barricade 211 of the oil-sealing structure 21 is parallel to the radial direction "R" of the motor 20 and pressed against the bushing 231. Thus, the thickness of the barricade 211 is gradually reduced from the main body 212 of the oil-sealing structure 21 toward the shaft 242. In addition, the barricade 211 of the oil-sealing structure 21 further includes at least one crook 211*a*1 located at the distal end thereof and bent toward the bearing 22 and the base 23.

Figure 3A:
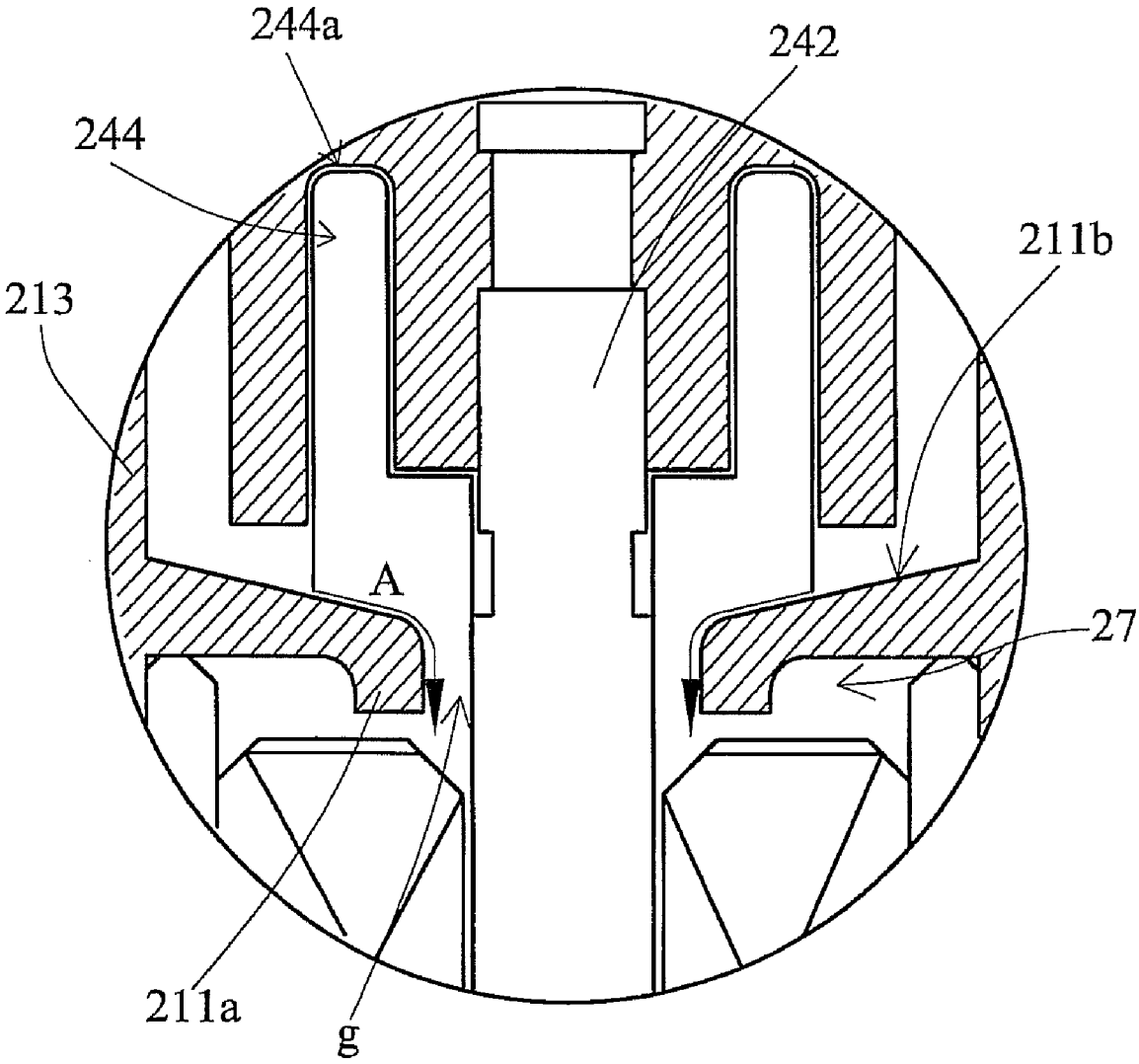
FIG. 3A is a partially schematic view of the oil-sealing structure, the hub and the shaft in FIG. 2A.

Referring also to FIG. 3A, FIG. 3A is a partially schematic view of the oil-sealing structure 21, the hub 241 and the shaft 242 in FIG. 2A. A gap "g" is formed between the barricade 211 of the oil-sealing structure 21 and the outside of the shaft 242. The lubricating liquid partially overflows to the oil-sealing structure 21 through the gap "g". In FIGS. 2A and 2B, the main body 212 of the oil-sealing structure 21 includes a top wall 213 and a bottom wall 214. A separation distance "d" is spaced between the top wall 213 of the main body 212 of the oil-sealing structure 21 and the extending walls 243 of the hub 241. Because the separation distance "d" is extremely small, the lubricating liquid is prevented from overflowing. An inner side of the bottom wall 214 of the main body 212 of the oil-sealing structure 21 is pressed against the outside of the bushing 231.

In FIG. 3A, the slot 244 includes a slot-bottom plane 244*a* higher than the top wall 213 of the main body 212 of the oil-sealing structure 21. An oil-storing space 27 is defined by the main body 212 of the oil-sealing structure 21, the bushing 231 and the bearing 22. When the fan 2 begins to rotate, the lubricating liquid originally stored in the bearing 22 is gradually released by pressure difference and distributed between the bearing 22 and the shaft 242. When the fan 2 continues to rotate, the superfluous lubricating liquid overflows from a breach between the bearing 22 and the shaft 242. The superfluous lubricating liquid guided by the crook 211*a*1 of the barricade 211 is guided into the oil-storing space 27, i.e., the oil-storing space 27 is utilized to store the lubricating liquid overflowing from a breach between the bearing 22 and the shaft 242. Driven by gravity, the superfluous lubricating liquid stored in the oil-storing space 27 returns again to the breach between the bearing 22 and the shaft 242. Specifically, no loss occurs for the lubricating liquid. The lubricating liquid is stably released from the bearing 22 and returns to the breach between the bearing 22 and the shaft 242. The lubrication effect continues. Thus, noise is effectively decreased and the operating life of the motor 20 can be extended.

Because of the altitude of the slot-bottom plane 244*a* of the slot 244 being higher than that of the top wall 213 of the main body 212 of the oil-sealing structure 21, additional lubricating liquids partially leaking from the gap "g" can be received in the slot 244. When the fan 2 rotates, the lubricating liquid leaking from the gap "g" is moved along the outside of the shaft 242 to the slot 244, i.e., the lubricating liquid is centrifugally concentrated to the slot 244. Because of the inclined top surface 211*b* of the barricade 211, the lubricating liquid located at the top surface 211*b* downstream flows back to the gap "g" and the oil-storing space 27, thus, lubricating liquid leakage is prevented. As shown by arrow "A" in FIG. 3A, when the volume of the lubricating liquid stored in the slot 244 rises to a predetermined value, the lubricating liquid stored in the slot 244 drops to the top surface 211*b* of the barricade 211 by gravity and recyclably moves along the crook 211*a*1 back to the gap "g".

Figure 3B:
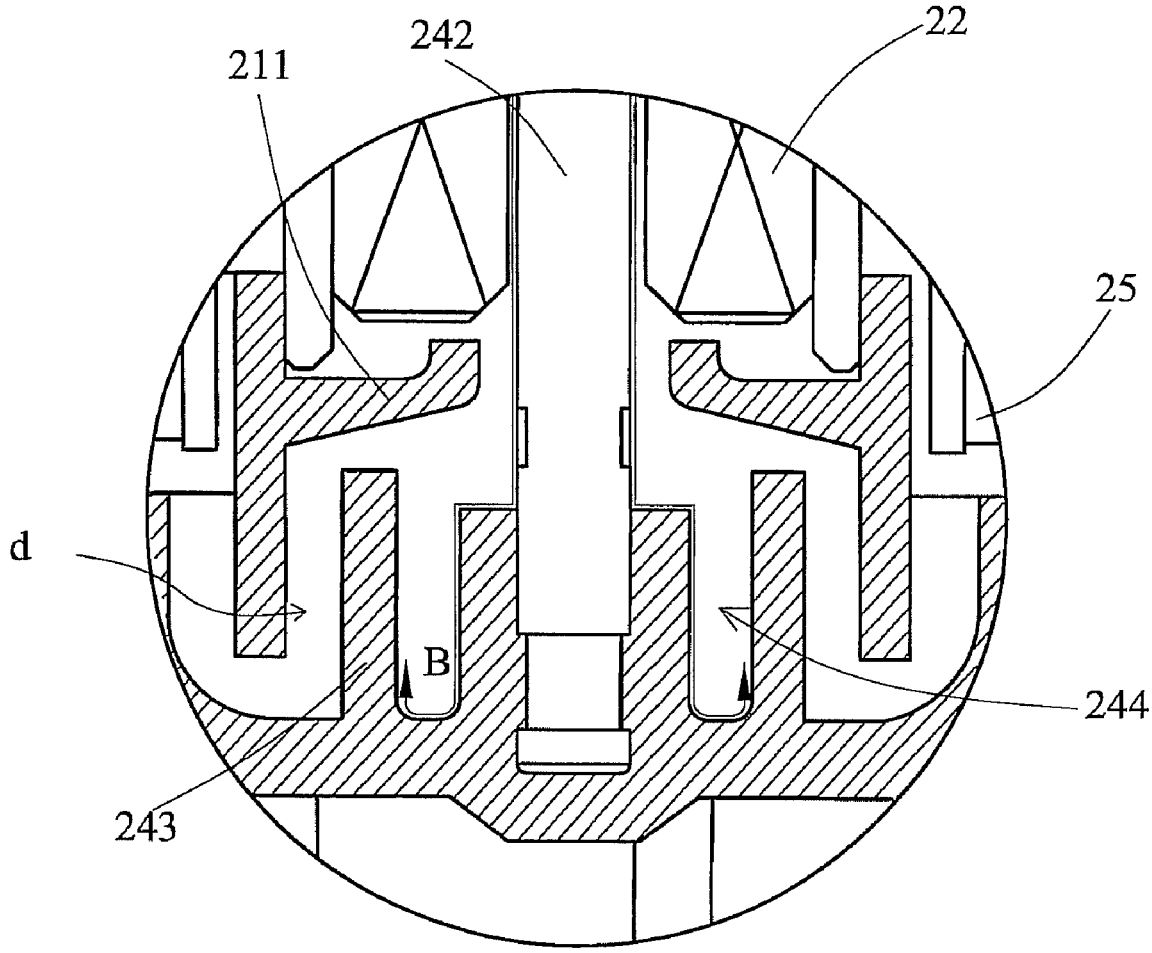
FIG. 3B is a schematic view of the inverted oil-sealing structure, the hub and the shaft in FIG. 3A.

FIG. 3B is a schematic view of the inverted oil-sealing structure 21, the hub 241 and the shaft 242. As shown by arrow "B" in FIG. 3B, when the inverted fan 2 is in use, the superfluous lubricating liquid moves along the outside of the shaft 242 back to the slot 244, i.e., the superfluous lubricating liquid does not flows out through the separation distance "d" located between the extending walls 243 of the hub 241 and the top wall 213 of the main body 212, thus, lubricating liquid leaking to the magnetic-conducting device 25 causing malfunction is prevented. Moreover, when converting the inverted fan 2 to the normal state, the lubricating liquid stored in the slot 244 returns to the breach between, the bearing 22 and the shaft 242 by moving along the same path (as shown in FIG. 3A). Thus, there is no waste for the lubricating liquid.

Figure 4A:
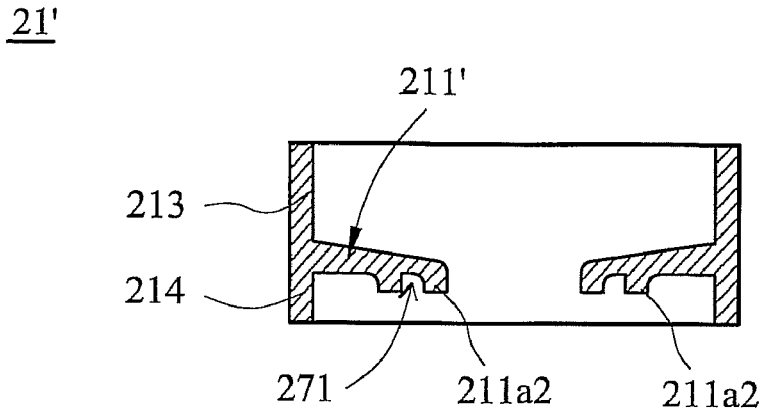
FIG. 4A is a schematic sectional view of another oil-sealing structure in FIG. 2A.
Figure 4B:
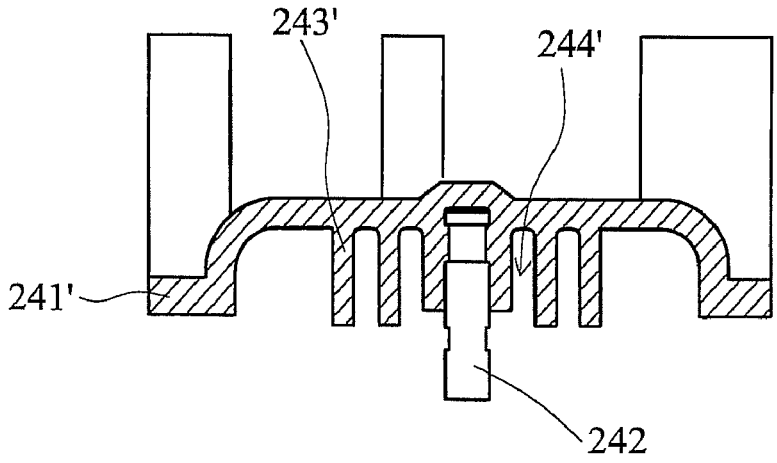
FIG. 4B is a schematic sectional view of another the hub and the shaft in FIG. 2A.

FIG. 4A is a schematic sectional view of another oil-sealing structure 21', and FIG. 4B is a schematic sectional view of another hub 241' and a shaft 242. In FIG. 4A, based on the actual user requirements, the barricade 211' of the oil-sealing structure 21' can be designed with a plurality of crooks 211*a*2. The guiding slots 271 are divided by the crooks 211*a*2 to store the lubricating liquid therein. In FIG. 4B, a plurality of slots 244' are formed on the hub 241', thereby increasing space for storing the lubricating liquid. Note that the oil-sealing structure 21' of the second embodiment still provide the same effects as described for fan 2 of the first embodiment no matter what amount and size of the guiding slots 271 and the slots 244' are provided.

Referring again to FIG. 2A and 2B, the bottom wall 214 of the main body 212 of the oil-sealing structure 21 and the outside 23 la of the bushing 231 are fitted tightly, and the bottom wall 214 of the main body 212 is pressed against the magnetic-conducting device 25. Because of high interference force, the oil-sealing structure 21 is connected with the bushing 231 by means of tightly fit, and the abutment of the magnetic-conducting device 25 and the bottom wall 214 of the main body 212 can limit the movement of the magnetic-conducting device 25, and thus the magnetic-conducting device 25 is securely fixed to the base 23.

Figure 5A:
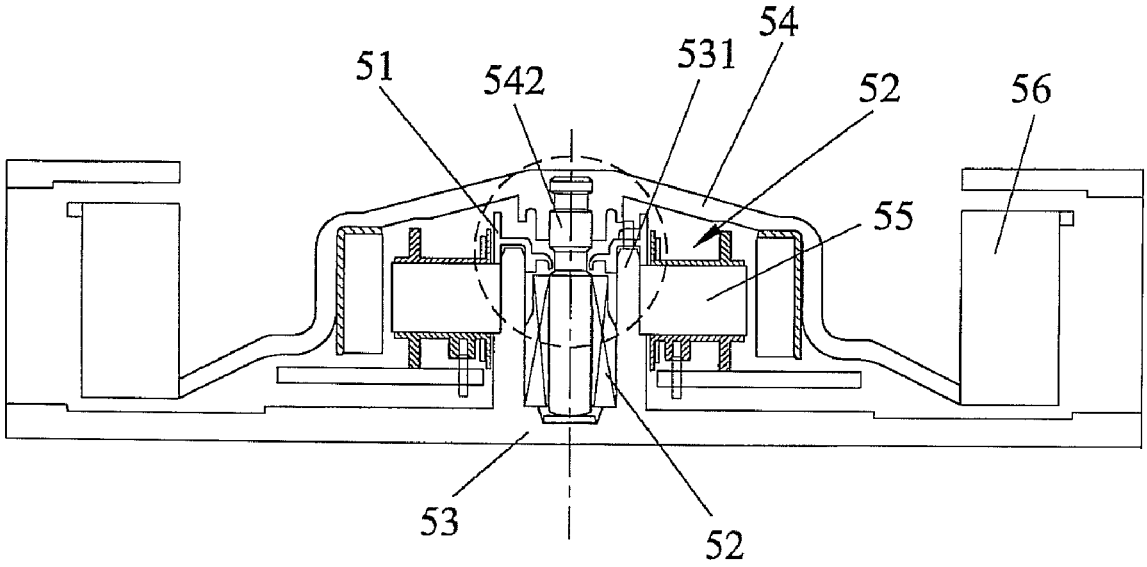
FIG. 5A is a schematic sectional view of a fan according to a second embodiment of the present invention.
Figure 5B:
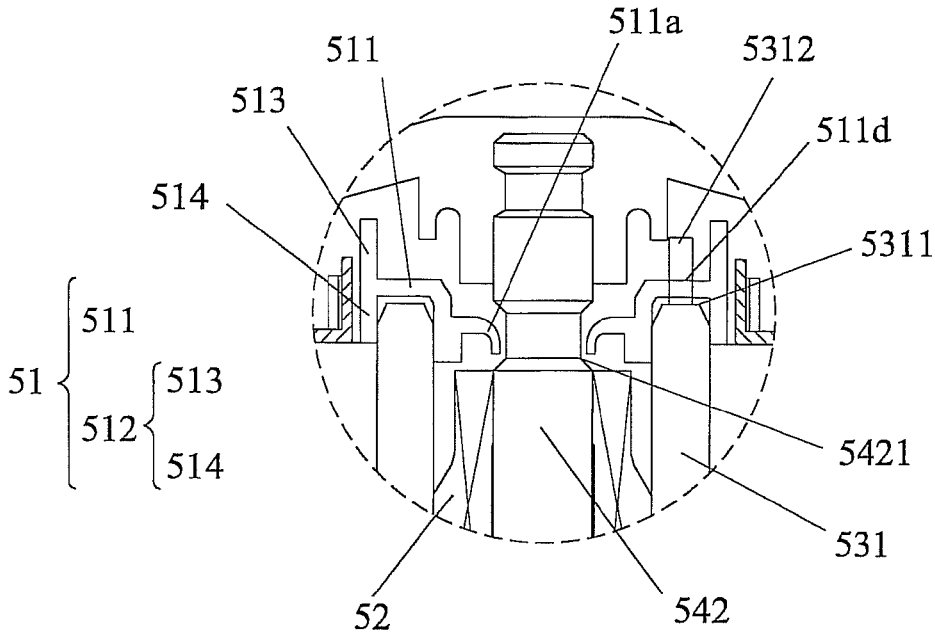
FIG. 5B is a partially enlarged schematic illustration of FIG. 5A.

Referring also to FIG. 5A and FIG. 5B, FIG. 5A is a schematic sectional view of a fan 5.according to a second embodiment of the present invention, and FIG. 5B is a partially enlarged schematic illustration of FIG. 5A. In order to enhance the combining strength of the bushing 531 and the oil-sealing structure 51, the bushing 531 and four heat-melt portions 5312 on the top wall 5311 of the bushing 531 (as shown in FIG. 6A-6D) can be made by heat-melt macromolecule polymers. Each of the heat-melt portions 5312 can is a circle pillar. In addition, the oil-sealing structure 51 telescoped to the top wall 5311 of the bushing 531 and the oil-sealing structure 51 having a main body 512 and a barricade 511 inwardly extended toward the shaft 542, wherein at least one through hole 511*d* is disposed in the barricade 511. The shape, the size, the number, and the corresponding position of the heat-melt portions 5312 match with those of the through holes 511*d*. When the oil-sealing structure 51 is telescoped to the bushing 531, each heat-melt portion 5312 of the bushing 531 passes through the corresponding through holes 511*d*, and the protruding heat-melt portions 5312 are heated by using heat-melt machine.

The heat-melt portions 5312 are made by macromolecule polymers, and thus when the heat-melt portions 5312 are melted after heating, each heat-melt portion 5312 is formed on the oil-sealing structure 51 to combine with the barricade 511 (as shown in FIG. 5C, FIG. 5D, FIG. 5E, FIG. 6C, and FIG. 6D). After cooling the heat-melt portions 5312, the heat-melt portions 5312 can be solidified on the oil-sealing structure 51. Thus, the oil-sealing structure 51 can be combined with the bushing 531 firmly and it can limit the movement of the oil-sealing structure 51. Furthermore, the melted size of each heat-melt portions 5312 can be modified according to the actual requirements by adjusting the parameters (such as heating time, heating area, and pressure) of the heat-melt machine.

In another embodiment, the amount of the heat-melt portions 5312 and the amount of the through holes 511*d* can be less or more than four. However, the amount of the heat-melt portions 5312 can not be larger than the amount of the through holes 511*d*. The best mode embodiment is the amount of the heat-melt portions 5312 is equal to that of the through holes 511*d*.

Figure 6A:
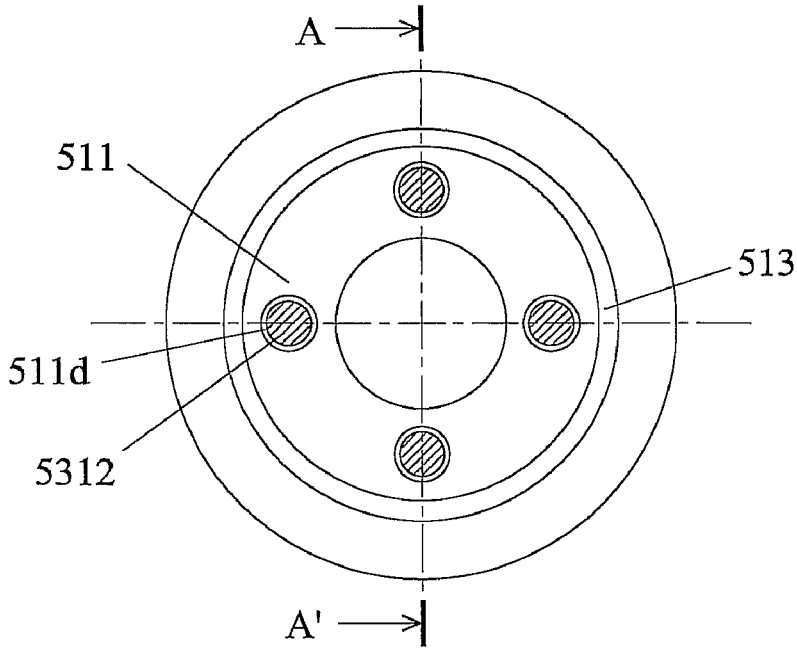
FIG. 6A is a top view showing the oil-sealing structures combining the bushing.
Figure 6B:
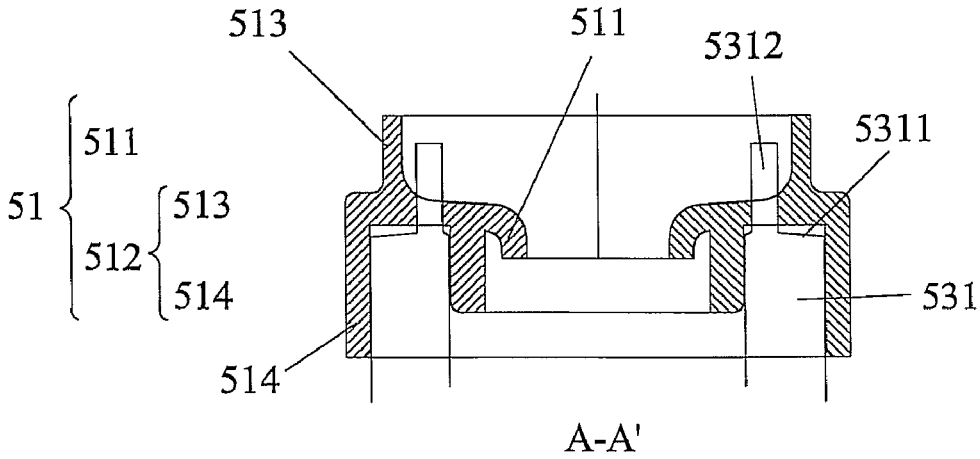
FIG. 6B is a schematic sectional view viewed from line A-A' of FIG. 6A
Figure 6C:
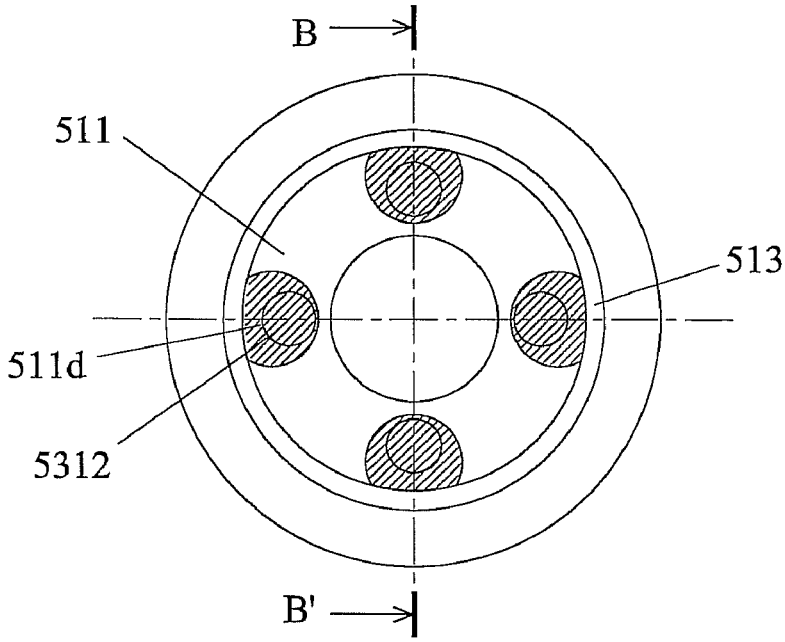
FIG. 6C is a top view showing the bushing of FIG. 6A after heating
Figure 6D:
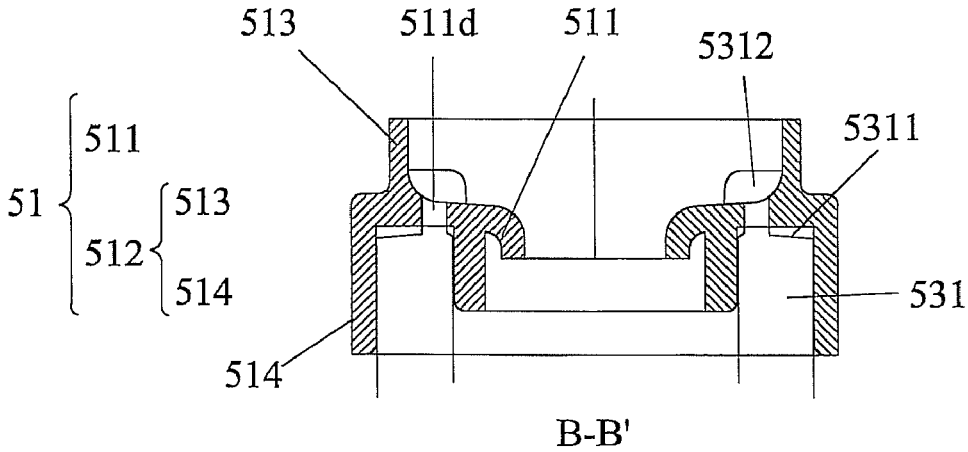
FIG. 6D is schematic sectional view viewed from line B-B' of FIG. 6C
Figure 6E:
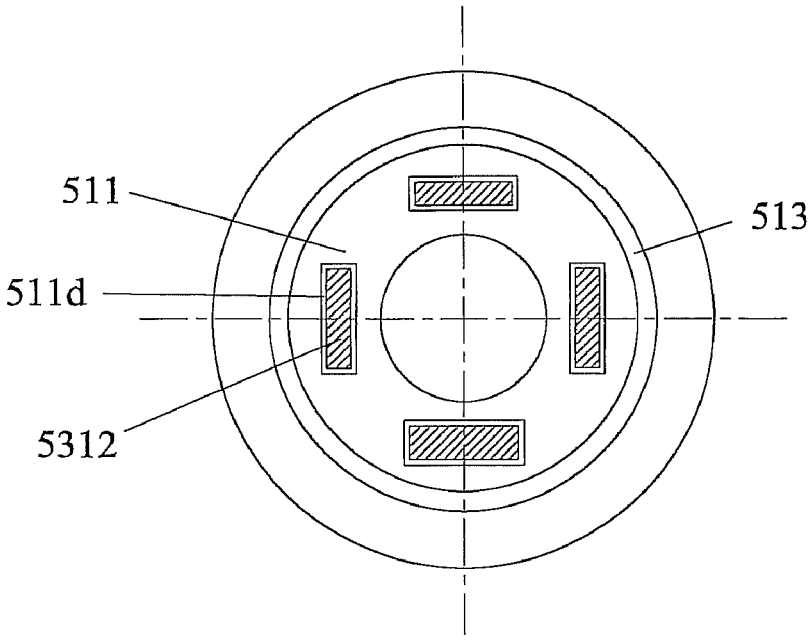
FIG. 6E is a top view of another embodiment showing the oil-sealing structures combining the bushing.
Figure 6F:
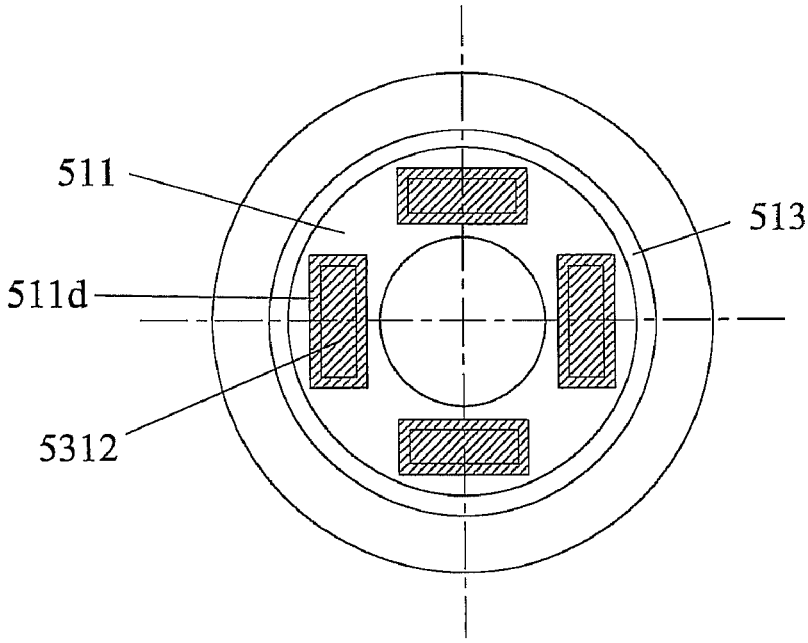
FIG. 6F is a top view showing the bushing of FIG. 6E after heating

As mentioned above, the modification of the heat-melt portions 5312 can vary in different ways. Referring to FIG. 6E and FIG. 6F, the protruding heat-melt portions 5312 can also be a rectangular pillar or polygonal pillar. In addition, the combining way of the oil-sealing structure 51 and the bushing 531 is not restricted in the material of the bushing 531 or the shapes of the heat-melt portions 5312. The goal of the combining way is to fix the oil-sealing structure 51 and the bushing 531 firmly.

Figure 5C:
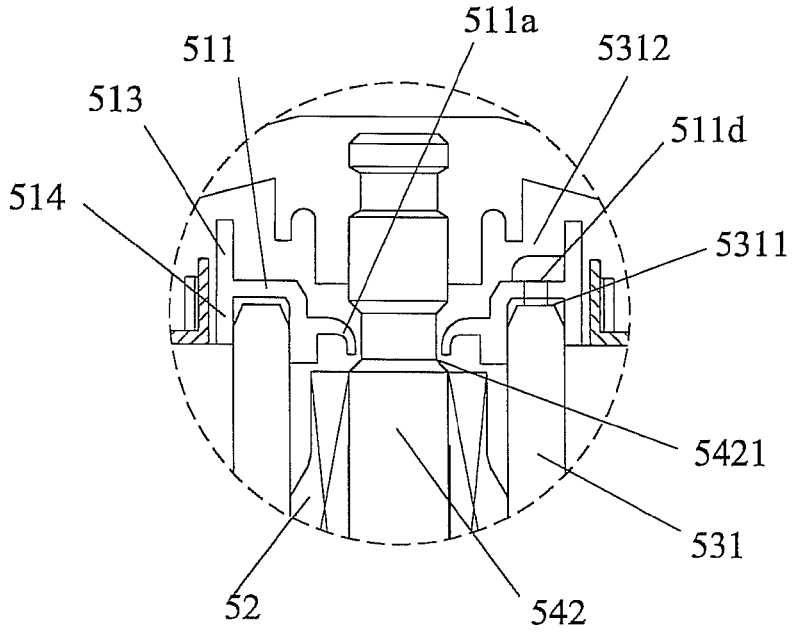
FIG. 5C is a partial schematic illustration of FIG. 5B showing the heat-melt portion after heating.

In order to prevent the superfluous lubricating liquid from flowing out of the breach between the bearing 52 and shaft 542. Another design for the shaft 542 is provided. Referring to FIGS. 5A-5C, a position concave portion 5421 is formed and surrounding a periphery of the shaft 542. When the oil-sealing structure 51 telescopes to the top wall of the bushing 531, the oil-sealing structure 51 further includes a crook 511*a* extending inwardly toward the shaft 542. The crook 511*a* can extend to the position concave portion 5421 without touching the shaft 542. The design of the crook 511*a* is not only to prevent the foreign matter from entering to the bearing 52 but avoid the vaporizing of the lubricating liquid. Furthermore, when the fan 5 operates, there is a centrifugal force for the shaft 542 to push the shaft 542 upwardly. Since the crook 511*a* can extend to the position concave portion 5421, it can prevent the shaft 542 from separating from the fan 5. The motor 50 also includes a base 53 used to load the bearing 52, and wherein the bushing 531 and the base 53 are integrally formed or molded as a single piece. The main body 512 of the oil-sealing structure 51 further includes a bottom wall 514, and when the oil-sealing structure 51 telescopes to the bushing 531, the bottom wall 514 fits tightly to the magnetic-conducting device 55.

Figure 5D:
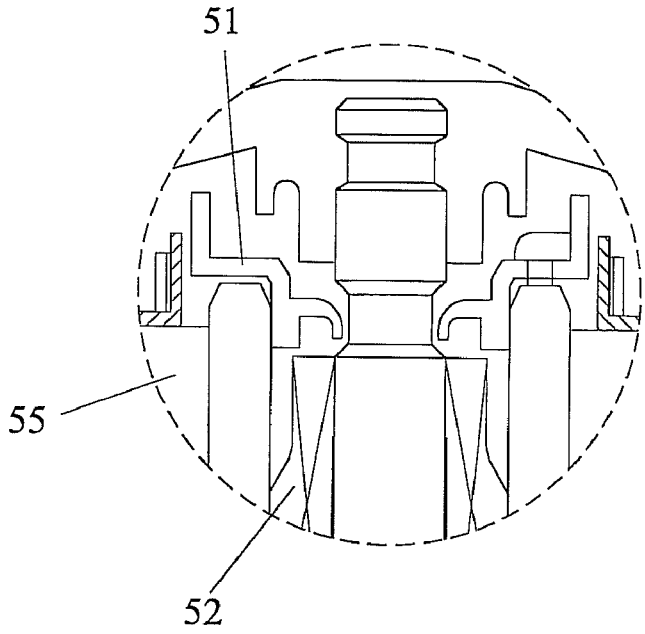
FIG. 5D is a partially enlarged schematic illustration of another oil-sealing structure in FIG. 5A.
Figure 5E:
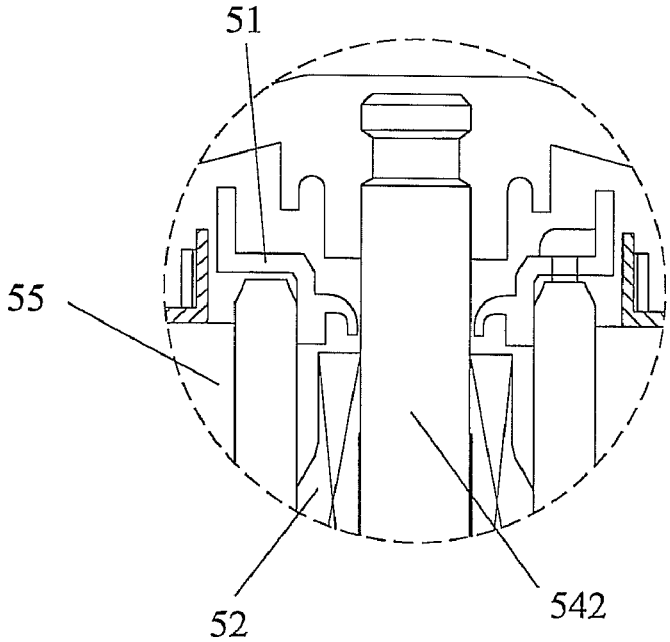
FIG. 5E is a partially enlarged schematic illustration of the oil-sealing structure of FIG. 5D applied in another kind of shaft.

In addition, referring to the FIG. 5D and FIG. 5E, the oil-sealing structure 51 can also contain no bottom wall and without the effect of fixing the magnetic-conducting device 55.

Based on the described features, the oil-sealing structure of the embodiments can solve the problem of conventional oil-sealing bearings, by eliminating noise and sticking caused by insufficient oil lubrication of the shaft, and securely combine with the bushing by the way of heat-melting. The motor of the present invention can also be applied in the axial fan or the centrifugal fan to effectively increase lifetime of the product.

While the present invention has been described by way of example and in terms of the preferred embodiments, it is to be understood that the present invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A motor, comprising:

a hub and a shaft comprising an end connected to the hub;

a bushing for supporting the other end of the shaft;

a bearing disposed in the bushing and used to telescope the shaft; and an oil-sealing structure telescoped to the shaft and the oil-sealing structure comprising a main body and a barricade inwardly extending toward the shaft so that the oil-sealing structure is fixedly connected with the bushing;

wherein the barricade of the oil-sealing structure further comprises at least one crook bent toward the bearing, and the barricade of the oil-sealing structure further comprises at least one guiding slot formed and divided by the crook.

2. The motor as claimed in claim 1, wherein the oil-sealing structure and the bushing are fitted tightly, thereby pressing the oil-sealing structure against the bushing, and the barricade comprises a top surface, and a declined angle is formed between the top surface of the barricade and a radial direction of the motor.

3. The motor as claimed in claim 2, wherein the thickness of the barricade is gradually reduced from the main body of the oil-sealing structure toward the shaft, and the barricade and the main body of the oil-sealing structure are integrally formed or molded as a single piece.

4. The motor as claimed in claim 1, further comprising a lubricating liquid disposed between the bearing and the shaft, wherein an oil-storing space is defined by the main body of the oil-sealing structure, the bushing and the bearing, and the oil-storing space is utilized to store the lubricating liquid overflowing from a breach between the bearing and the shaft.

5. The motor as claimed in claim 4, wherein the motor further comprises a gap formed between the barricade of the oil-sealing structure and an outside of the shaft, and the lubricating liquid is partially overflowing to the oil-sealing structure through the gap.

6. The motor as claimed in claim 5, wherein the hub further comprises a plurality of extending walls surrounding a periphery of the shaft and a plurality of slots, each slot is formed between each two adjacent extending walls, the slot is utilized to receive the lubricating liquid overflowing from the gap, and a slot-bottom plane higher than the main body of the oil-sealing structure.

7. The motor as claimed in claim 6, wherein the main body of the oil-sealing structure comprises a top wall, and a separation distance is spaced between the top wall of the main body of the oil-sealing structure and the extending walls of the hub.

8. The motor as claimed in claim 1, wherein the barricade of the oil-sealing structure further comprises a bottom surface, the bottom surface of the barricade of the oil-sealing structure is parallel to the radial direction of the motor and pressed against the bushing.

9. The motor as claimed in claim 1, wherein the main body of the oil-sealing structure comprises a bottom wall, the motor further comprises a magnetic-conducting device used to telescope the bushing, the bottom wall is presses against the magnetic-conducting device, and an inner side of the bottom wall of the main body of the oil-sealing structure is pressed against an outside of the bushing.

10. The motor as claimed in claim 1, further comprising a base, wherein the bushing is extending from the base, and the bushing comprises an opening end, and the oil-sealing structure is disposed on an opening end of the bushing.

11. The motor as claimed in claim 1, wherein the bushing has a top wall and at least one heat-melt portion disposed on the top wall of the bushing, at least one through hole is disposed in the barricade of the oil-sealing structure, and when the oil-sealing structure is telescoped to the bushing, each heat-melt portion of the bushing passes through the corresponding through hole of the oil-sealing structure to expose, and the heat-melt portion is melted by heating and cooled to be formed on the oil-sealing structure so as to combine the oil-sealing structure with the bushing firmly.

12. The motor as claimed in claim 11, wherein the main body of the oil-sealing structure further comprises a bottom wall, the motor further comprises a magnetic-conducting device used to telescope the bushing, and when the oil-sealing structure telescopes to the bushing of the main body of the oil-sealing structure, the bottom wall fits tightly to the magnetic-conducting device.

13. The motor as claimed in claim 11, wherein the oil-sealing structure further comprises a crook extending inwardly toward the shaft without touching the shaft.

14. The motor as claimed in claim 13, wherein a position concave portion is formed and surrounding a periphery of the shaft to enable the crook to extend to the position concave portion.

15. The motor as claimed in claim 11, wherein the heat-melt portion is a circle pillar, a rectangular pillar, or polygonal pillar, and a shape, a size, and a number of the heat-melt portion match with the corresponding through hole.

16. The motor as claimed in claim 11, wherein the bushing and the heat-melt portion comprises heat-melt macromolecule polymers.

17. A fan, comprising:

a plurality of blades and a motor, the motor comprising:

a hub and a shaft comprising an end connected to the hub, wherein the plurality of blades is connected with and surrounding around the hub;

a bushing for supporting the other end of the shaft;

a bearing disposed in the bushing and used to telescope the shaft; and an oil-sealing structure telescoped to the shaft to fit tightly and the oil-sealing structure comprising a main body and a barricade inwardly extending toward the shaft so that the oil-sealing structure is fixedly connected with the bushing; and wherein the hub further comprises a plurality of extending walls surrounding a periphery of the shaft and a plurality of slots, each slot is formed between each two adjacent extending walls, and a slot-bottom plane higher than the main body of the oil-sealing structure.

18. The fan as claimed in claim 17, wherein the barricade comprises a top surface, and a declined angle is formed between the top surface of the barricade and a radial direction of the motor and the thickness of the barricade is gradually reduced from the main body of the oil-sealing structure toward the shaft.

19. The fan as claimed in claim 17, wherein the bushing has a top wall and at least one heat-melt portion disposed on a top wall of the bushing, at least one through hole is disposed in the barricade of the oil-sealing structure, and when the oil-sealing structure is telescoped to the bushing, each heat-melt portion of the bushing passes through the corresponding through hole of the oil-sealing structure to expose, and the heat-melt portion is melted by heating and cooled to be formed on the oil-sealing structure so as to combine the oil-sealing structure with the bushing firmly.

* * * * *